US005130289A

United States Patent [19]

Cooper et al.

[11] Patent Number: 5,130,289

[45] Date of Patent: Jul. 14, 1992

[54] PRESSURE SENSITIVE RECORD MATERIAL

[75] Inventors: John B. Cooper, Lasne, Belgium; Tracey A. Doman, Chalfont St. Peter, England

[73] Assignee: The Wiggins Teape Group Limited, Basingstoke, England

[21] Appl. No.: 598,768

[22] PCT Filed: Oct. 5, 1988

[86] PCT No.: PCT/GB88/00825

§ 371 Date: Jun. 7, 1989

§ 102(e) Date: Jun. 7, 1989

[87] PCT Pub. No.: WO89/03312

PCT Pub. Date: Apr. 20, 1989

Related U.S. Application Data

[63] Continuation of Ser. No. 378,199, Jun. 7, 1989, abandoned.

[30] Foreign Application Priority Data

Oct. 7, 1987 [GB] United Kingdom ..... 8723588

[51] Int. Cl.[5] ..... B41M 5/132

[52] U.S. Cl. ..... 503/200; 503/207; 503/226

[58] Field of Search ..... 427/150–152; 428/211, 537.5, 913, 914; 503/200, 226, 207

[56] References Cited

U.S. PATENT DOCUMENTS

| | | | |
|---|---|---|---|
| 2,505,470 | 4/1950 | Green | 427/150 |
| 2,505,471 | 4/1950 | Green | 427/150 |
| 3,803,074 | 4/1974 | Jenkins | 427/152 |
| 4,348,234 | 9/1982 | Cespon | 427/150 |
| 4,422,671 | 12/1983 | Cespon | 427/150 |
| 4,431,213 | 2/1985 | Hofer et al. | 428/327 |

FOREIGN PATENT DOCUMENTS

| | | | |
|---|---|---|---|
| 1064478 | 5/1954 | France | 427/150 |
| 666450 | 2/1952 | United Kingdom | 427/150 |

*Primary Examiner*—Pamela R. Schwartz

*Attorney, Agent, or Firm*—Burns, Doane, Swecker & Mathis

[57] ABSTRACT

Acid sized carbonless base paper incorporating a sulphate based filler, particularly calcium sulphate, is less base reactive than otherwise similar paper made using conventional clay (kaolin) fillers. Carbonless paper, particularly CB paper, made from such base is less susceptible to undesired discoloration arising from base reactivity.

6 Claims, No Drawings

PRESSURE SENSITIVE RECORD MATERIAL

This application is a continuation of application Ser. No. 07/378,199, filed Jun. 7, 1989, now abandoned.

This invention relates to pressure sensitive record material and especially to such record material using base paper made using a particular combination of filler and sizing agent.

As is well known in the art, pressure sensitive record material typically functions by separating the colour reactive components by a pressure rupturable barrier. Most commonly this barrier is provided by microencapsulating a solution in a suitable organic solvent of one of the reactive components. On application of imaging pressure the microcapsules are ruptured, liberating the solution of one of the reactive components into reactive contact with the other component thereby forming a coloured mark or image corresponding to the applied imaging pressure. It is also known to use other forms of pressure rupturable barrier such as a dispersion of a solution in a waxy or other continuous layer or a honeycomb structure instead of microcapsules.

Most commonly, in pressure sensitive record material the reactive components are present in coatings on facing surfaces of upper and lower sheets, the coating on the lower surface of the upper sheet comprising the isolated and usually microencapsulated solution of electron donating chromogenic material and the coating on the upper surface of the lower sheet comprising the electron accepting coreactant.

Sheets carrying microencapsulated material on their lower surfaces are usually referred to as "CB" (coated back) sheets and the sheets carrying a reactive coating on their upper surfaces are usually referred to as "CF" (coated front) sheets. Intermediate sheets carrying both microencapsulated material and a reactive coating (on their opposed surfaces) are usually also provided, and these are usually referred to as "CFB" (coated front and back) sheets. In an alternative system, the microcapsules and the reactive material are carried within the paper as a loading.

The base paper used in the manufacture of such pressure sensitive record material (carbonless copying paper) is generally a conventional fine paper (apart from special grades on other bases).

The present invention addresses a problem which has been found to arise if the base paper is made using an acid sizing system. This problem, termed "base reactivity", manifests itself as an undesirable localised or general colouration of the base paper after application of microencapsulated chromogenic materials thereto. This colouration may arise immediately on contact with the microencapsulated chromogenic materials or at a later stage, and is thought to be due to one or more of the following factors:

a) the presence of a certain amount of unencapsulated chromogenic material solution mixed with the microcapsules;

b) accidental rupture of microcapsules in handling, storage, printing or use of the microcapsule coated paper; and c) incomplete transfer of chromogenic material solution to the CF surface of the sheet below when microcapsules are ruptured by imaging pressure. Hitherto, it had been assumed that the prime cause of base reactivity was the acidic nature of the alum used in acid sizing systems, since most chromogenic materials used in pressure sensitive record material are electron donating and hence develop colour in an acidic environment. Consequently, it had further been assumed that the choice of filler used in the base paper would not affect the base reactivity of the paper to a significant extent.

It has now surprisingly been found that the use of sulphate based fillers in place of the kaolin or other clay fillers used hitherto in acid sized base paper for pressure sensitive record material gives rise to substantially reduced base reactivity.

Sulphate salts of alkali earth metals, for example gypsum or blanc fixe have been proposed previously for use as papermaking fillers e.g. as described in TAPPI Monograph 19; "Paper Loading Materials", Chapter V, but the applicants are not aware of any previous disclosure or use of such fillers in base paper for pressure sensitive recording materials. The term "sulphate based filler" used herein means a filler which is a sulphate salt of an alkali earth metal.

Accordingly, the present invention provides pressure sensitive record material comprising an acid sized base paper carrying isolated droplets of a solution of chromogenic material each confined within a pressure rupturable barrier, in which the base paper contains a sulphate based filler.

In the invention the sulphate based filler is used in substitution for the clay e.g. kaolin, or other similar silicate fillers used previously. Indeed, it is highly desirable that the base paper contains substantially no clay or other silicate fillers since their presence would give rise to the undesired base reactivity described above. The sulphate based filler will usually be a calcium or barium sulphate. The use of calcium sulphate, as anhydrite or gypsum, as the sulphate based filler forms a particular aspect of the invention. Of course, the sulphate based filler used will not, of itself, have significant colour developer properties as this would defeat the object of using them. We have not found any difficulty arising from such properties when using conventional paper grades of sulphate based fillers, particularly calcium sulphate. However, laboratory testing of chemical reagent grades of calcium sulphate, particularly anhydrite, has indicated that such materials can be significantly colour developing. We are aware that chemical reagent grade anhydrite can be derived from a by-product in the manufacture of HF. Accordingly, we surmise that residual mineral acid or the presence of fluoride can make such materials far too colour developing to be useful as sulphate based fillers in this invention. Such materials should be avoided and are not included among sulphate based fillers as this term is used herein. Those skilled in the art will have no difficulty in avoiding such unwanted materials in practice. The filler can be included in the base in the conventional way by including it in the papermaking stock. The base paper, apart from the sulphate based filler, is a conventional base for carbonless paper. Typically, it will have a substance of from 35 to 100 g $m^{-2}$ and it may be surface sized and calendered if desired.

The sulphate based filler will typically form from 5% to 30%, preferably 7% to 15%, (anhydrous basis) by weight of the base paper. Amounts outside this range can be used but, particularly, the use of less than 3% filler is unlikely to be of any value. In the finished product the sulphate based filler may have a different degree of hydration from that of the starting material as the papermaking process involves both wet states and drying steps.

In referring to 'acid sized' base paper, we use the term in its ordinary papermaking sense of a sizing system which is fixed using aluminium in aqueous solution at an acid pH. The most common form is rosin/alum (in papermaking 'alum' means aluminium sulphate) sizing but the term 'acid sized' paper also refers to paper sized using stearate/alum, rosin/aluminium chloride and acid activated aluminate based sizing systems. Whilst the present invention may utilize paper sized by means of any of the sizing systems just mentioned, it is particularly applicable to rosin/alum sized papers.

The invention is primarily applicable to CB sheets of pressure sensitive record material i.e. sheets carrying a coating containing chromogenic material but neither containing nor coated with colour developer material, used or for use in multipart form sets. Thus, the use of a sulphate based filler, particularly calcium sulphate, in a CB sheet, forms a specific aspect of the invention. Sulphate based fillers can be used in CFB sheets or loaded or coated types of self-contained carbonless paper but in such sheets the reduction in base reactivity from the use of the sulphate based filler is likely to be overshadowed by the presence of the colour developer material coated onto or included within the sheet.

The pressure rupturable barrier surrounding the droplets of solution of chromogenic material is particularly provided by microencapsulating the droplets. Other forms of pressure rupturable barrier, as described above, can be used but are not preferred. The provision of a microcapsule coating or loading to produce the sheet of record material may use conventional carbonless technology. We do not believe that any criticality attaches to the particular microencapsulation technique used or the choice of solvent or individual colour formers. Plainly the reduction in the base reactivity sought by the invention is relevant to electron donating chromogenic materials, particularly those which can be classed as acid(coloured)-base(colourless) indicators, but not particularly to metal chelating colour forming systems. Typically, the chromogenic material will be a mixture of chromogenic compounds to give the desired image colour.

In a specific aspect the invention particularly provides sheet pressure sensitive record material comprising a base paper sized with a rosin/alum sizing system having, on one side only of the base, a coating of a microencapsulated solution of electron donating chromogenic material, the base paper including at least 3% and more particularly 5 to 30% by weight of calcium sulphate (anhydrous basis) as a filler, the base paper including substantially no clay or other silicate filler and the record material including substantially no electron accepting colour developer material.

In practice, the record material of the invention will be used as part of a form set. By way of illustration, a CB sheet of the invention would be the top sheet of the form set with, usually, one or more CFB sheets below and at the bottom of the set a CF sheet. Preferably, these lower sheets, particularly the CFB sheets, will incorporate a sulphate based filler in the base paper.

The following Examples illustrate the invention. All parts and percentages are by weight unless otherwise stated.

Test Methods

Dip Test

A strip of carbonless base paper is dipped into a solution of chromogenic material (see below) for 10 seconds. The strip is hung on a support and allowed to dry in air. The dried strip is placed on a piece of clean white card and heated in an oven having an air circulation fan at 100° C. for 5 minutes. The intensity of the developed colour is measured as described below. Usually several replicates are run and average results are quoted. The dip test mimics the effect of unencapsulated chromogenic material in CB paper reacting with colour developing cites in the base paper. The test is more severe than is usually seen in practice in CB paper but is useful in that it effectively amplifies the reactivity of the base paper making measurement of the effect easier. Toluene is used as the solvent to enable the strips to be dried to make measurement easier. The colour formers used in the dip test solution are as follows:

3,3-bis(4-dimethylaminophenyl)-6-dimethylaminophthalide (crystal violet lactone), 2-chloro-3-methyl-6-diethylaminofluoran, bis(4-N-methyl-N-phenylaminophenyl)-N-butylcarbazol-4-ylmethane, 3-chloro-6-N-cyclohexylaminofluoran, 2-(N-methyl-N-phenylamino)-6-(N-ethyl-N-(4-methylphenyl)amino)fluoran, and 3'-isopropyl-7-dibenzylamino-2,2'-spirobi-[2H-1-benzopyran]

totalling 5.75% (weight/volume) and formulated to give a black image with inorganic clay colour developer such as 'Silton' acid washed montmorillonite clay.

Calender Test

A pair of strips of CB coated paper are stacked, coated side down, and the pair run through a laboratory test calender. The colour developed on the top side of the lower sheet was measured (see below) 2 minutes after calendering. This test parallels a similar commonly used test for imaging of carbonless paper in which a CB and a CF sheet are stacked and calendered and the developed image on the CF surface is measured. In testing CB against CF paper the result would typically be about 50% as compared with the much higher values, indicating less colour, given in the current test.

Measurement of colour developed

The amount of light reflected from an imaged sample of paper from the dip or calender tests described above is compared with that reflected from an unimaged control of the same paper. The result is the percentage: 100× (sample/control), thus the higher the figure the less colour there is in the imaged sample and for present purposes the better—less base reactive—the sample under test. Usually, the test paper is in the form of a strip part of which is imaged and part unimaged so the two measurements are made on the same piece of paper. We use a test instrument having a broad band light source and detector and including a computational unit to make the measurements and calculate the results automatically. Such an instrument is described in our British Patent Specification No. 2054845. Results quoted are mean values from several replicates.

Filler Content of Base

The filler content of the base papers of the Examples was measured by ashing samples of the paper in air at 500° C. and weighing the residue. The figures for calcium sulphate are corrected by multiplying by a factor of 1.4 (determined empirically) to allow for partial reduction of the sulphate by the paper during ashing. The figures quoted are thus for anhydrous material.

EXAMPLE 1

Carbonless base paper of substance about 48 g $m^{-2}$ was made on a pilot scale papermaking machine using the following furnish.

| | | |
|---|---|---|
| Softwood sulphite pulp | 30% | |
| Hardwood (Eucalyptus) sulphate pulp | 70% | |
| Thin stock consistency | ca. 0.5% | fibre on water |
| Cationic polyacrylamide retention aid | 0.02% | on fibre |
| Sizing system | | |
| Rosin | 0.8% | on fibre |
| Alum | 2.0% | on fibre |
| Sizing pH | 5.0 | |

The filler retention achieved was 70% and the sizing was such as to give a Cobb value (1 min) of 22.

Various amounts of filler were added as a 10 to 15% slurry in water to the thin stock at the flowbox to give a variety of filler loadings in the base paper. Unfilled base paper and kaolin (china clay) filler were used to provide controls and processed natural anhydrite ("ALBICLAY-OPAK" supplied by Cargas Blancas Inorganicas S.A. of Gerona, Spain) was used as the sulphate based filler. The results of dip testing on the variously filled papers produced are summarised in Table 1 below.

TABLE 1

| | | | |
|---|---|---|---|
| | a) Kaolin (Control) Filler | | |
| % filler | 0 | 20 | 29 |
| Dip Test (%) | 85.2 | 78.2 | 77.5 |
| | b) Anhydrite Filler | | |
| % Filler | 0 | 12 | 26 |
| Dip Test (%) | 85.2 | 85.5 | 84.9 |

EXAMPLE 2

Carbonless base paper of substance about 48 g $m^{-1}$ was made using the same stock and sizing system as described in Example 1 but substituting a non-ionic polyacrylamide as retention aid for the cationic polyacrylamide used in Example 1. The sizing as measured by the 1 minute Cobb value was 20. As in Example 1 base paper containing varying amounts of kaolin or anhydrite were produced and the results of dip testing are set out in Table 2 below.

TABLE 2

| | | | | | |
|---|---|---|---|---|---|
| | a) Kaolin (Control) Filler | | | | |
| % Filler | 0 | 7.5 | 11 | 14 | 18 |
| Dip Test (%) | 87.2 | 78.9 | 78 | 75.1 | 72.8 |
| | b) Anhydrite Filler | | | | |
| % Filler | 0 | 6 | 9 | 12 | 18 |
| Dip Test (%) | 87.2 | 87.6 | 85.8 | 86.4 | 86.5 |

EXAMPLE 3

Carbonless base paper, containing filler, of substance about 50 g $m^{-2}$ was made as described in Example 1 on a pilot scale papermaking machine. Three different fillers were used. A conventional kaolin clay paper filler was used as a control and Albiclay-Opak anhydrous calcium sulphate and ground gypsum were used as examples of the invention. A cationic polyacrylamide retention aid was used with the clay filler and a non-ionic polyacrylamide retention aid with the sulphate based fillers. Samples of the trial papers were dip tested and further samples were coated, using a laboratory coater, with a conventional CB coating mix. The CB coating mix contained microcapsules of a solution of colour formers in a conventional carbonless solvent together with binder and stilting agents. The combination of colour formers was substantially the same as that used in the dip test (the quantities of individual colour formers were somewhat different) and was (also) formulated to develop a black copy image with an inorganic colour developer such as 'Silton' acid washed montmorillonite clay. The results of dip testing the base paper and calender testing the CB coated paper are set out in Table 3 below.

TABLE 3

| | | | |
|---|---|---|---|
| | a) Kaolin (Control) Filler | | |
| % Filler | 12 | 17 | 25 |
| Dip Test (%) | 75.9 | 73.9 | 68.3 |
| Calender Test (%) | 95.2 | 92.4 | 87.5 |
| | b) Anhydrite | | |
| % Filler | 19 | 30 | 48 |
| Dip Test (%) | 88.9 | 86.8 | 83.1 |
| Calender Test (%) | 96.0 | 96.3 | 93.6 |
| | c) Gypsum | | |
| % Filler | 13 | 40 | |
| Dip Test (%) | 90.7 | 90.4 | |
| Calender Test (%) | 97.6 | 98.2 | |

These results, together with those from Examples 1 and 2, show that the sulphate based fillers used give base paper which is substantially less base reactive than conventional kaolin clay filler in acid sized carbonless base.

We claim:

1. A coated pressure sensitive record material comprising: an acid sized base paper coated with isolated droplets of a solution of chromogenic material reactable with a color developer to make a color, each droplet confined within a pressure rupturable barrier, the base paper containing a sulphate based filler.

2. The coated record material as claimed in claim 1 wherein the sulphate based filler is calcium sulphate as anhydrite or gypsum.

3. The coated record material as claimed in either claim 1 or claim 2 wherein the amount of sulphate based filler is from 3 to 30% by weight (anhydrous basis) of the base paper.

4. The coated record material as claimed in claim 3 wherein the amount of sulphate based filler is from 7 to 15% by weight (anhydrous basis) of the base paper.

5. The coated record material as claimed in claim 1 in the form of a CB sheet.

6. The coated record material as claimed in claim 1 wherein the base paper is sized with a rosin/alum size.

* * * * *